United States Patent [19]

Tamburro

[11] 4,239,323

[45] Dec. 16, 1980

[54] CIRCUIT BOARD KEYING ARRANGEMENT

[75] Inventor: Peter J. Tamburro, Hanover Township, Morris County, N.J.

[73] Assignee: Bell Telephone Laboratories, Incorporated, Murray Hill, N.J.

[21] Appl. No.: 10,362

[22] Filed: Feb. 8, 1979

[51] Int. Cl.[3] ..... H01R 13/64

[52] U.S. Cl. ..... 339/186 M; 339/176 MP

[58] Field of Search ..... 361/399, 411, 412, 414, 361/415; 339/186 RM, 184 R, 184 M, 17 C, 17 L, 17 M, 17 R, 75 MP, 176 MP

[56] References Cited

U.S. PATENT DOCUMENTS

| | | | |
|---|---|---|---|
| 3,177,461 | 4/1965 | Hagan et al. | 339/184 M |
| 3,246,279 | 4/1966 | Storcel | 339/184 M X |
| 3,869,185 | 3/1975 | Teagno | 339/75 M X |

OTHER PUBLICATIONS

Dwg. No. A-554460, "427A D Connector Assembly," Western Electric Co., 3/7/67.

Dwg. No. A-554506, "908 D Connector Assembly," Western Electric Co., 4/22/70.

*Primary Examiner*—Eugene F. Desmond

*Attorney, Agent, or Firm*—Jerry W. Herndon

[57] ABSTRACT

An arrangement for keying plug-in circuit boards and their receptacles such that a board cannot be inserted into an incorrect receptacle. First and second projections (FIG. 1:10, 11) are located on a board (1) at ones of a plurality of first and second encoded locations (FIG. 2:A–D and A′–D′). The locations are proximate to and parallel to one edge of the board associated with a receptacle guide rail (FIG. 1:2). The guide rail contains first and second stops (12, 13) associated individually with the first and second projections. The initial projection (10) to enter the receptacle during board insertion and the initial stop (13) encountered by the initial projection and associated with the other projection (11) are dimensionally offset with respect to each other so that the initial projection bypasses the initial stop.

3 Claims, 9 Drawing Figures

CIRCUIT BOARD KEYING ARRANGEMENT

TECHNICAL FIELD

This invention relates to structural arrangements associated with plug-in circuit boards and circuit board receptacles to prevent the insertion of boards into any but correct receptacles.

BACKGROUND OF THE INVENTION

In general, many electronic systems are today designed as modular systems composed of large numbers of a few types of general and special purpose plug-in circuits. Typically, the circuits are contained on circuit boards which are inserted into receptacles containing connectors which electrically engage terminals on the boards. For economic reasons, the different types of boards that might be required in any system are usually compatible with all the receptacles of the system. This means, of course, that without some form of restraint, any of the boards may be physically inserted into any of the compatible receptacles of the system irrespective of whether or not it is the correct type of board for the receptacle. This, in turn, endangers the reliability of any such system due to human error when replacing faulty boards and the like.

In general, it is known to provide keying arrangements in connection with many types of plug-in devices to prevent inadvertent misuse. A common example is the use of the different orientations of terminals and contacts in male and female power plugs and receptacles for different voltage and current ratings. The extension of this general principle of keying to circuit boards is also known.

U.S. Pat. No. 3,177,461, which issued to T. G. Hagan on Apr. 6, 1965, discloses one circuit board keying arrangement in which tubular members are colinearly mounted in a receptacle and on a circuit board with their axes parallel to the direction of insertion of the board into the receptacle. Each tubular member has a portion of its tubular section removed as if a cut were made through its axis from one end thereof partially along its length and then at right angles out to its tubular surface. These tubular members are manually rotated to prescribed positions and locked in place to form the unique keys. Only when the tubular ends of the members in the receptacle and on the board intermesh can a board be completely inserted into the receptacle.

Another known circuit board keying arrangement involves placing slots in coded locations at the terminal end of a board. The slots run parallel to the direction of board insertion. Thin wires are located in front of and across the receptacle connector and align with slots in a correct board or block the final insertion of an incorrect board into the connector.

The foregoing prior art and variations thereof, although effective, often suffer from one or more of several disadvantages. Some require manual operations to arrange the keying on each board. This is particularly troublesome when large numbers of circuit boards are involved. Others require high precision in the manufacture and assembly of the keying members in order to achieve a satisfactory arrangement having sufficiently large numbers of unique keys. The board and receptacle space consumed by keying arrangements is often excessive. Most arrangemens are also unsatisfactory for retrofitting into existing systems that do not have a keying arrangement on their boards and receptacles.

The foregoing problems of the prior art are partially solved in an arrangement by T. G. Grau and A. M. Wittenberg for which U.S. patent application Ser. No. 10,306 has been filed contemporaneously with the filing of this application. In the Grau et al arrangement, a first projection is located on a board in one of a plurality of first coded locations. These coded locations are arranged colinearly along an edge of the board associated with a guide rail of the receptacle in the direction of insertion of the board into the receptacle. A second projection is located on the board in an associated one of a like plurality of second coded locations arranged colinearly along the opposite edge of the board associated with another guide rail. Each of the first locations is associated with a different one of the second locations and the associated first and second locations are ordered in opposite directions. Each pair of associated first and second locations defines a unique key. First and second stops associated, respectively, with the first and second projections are located on the guide rails in the receptacle in the same spatial relationship as the projection.

DISCLOSURE OF THE INVENTION

My invention further improves features of the Grau et al. arrangement. Both the first and second projections are located proximate to and parallel to one edge of the board associated with one of the guide rails. Both of the first and second stops are connected to that guide rail on a side thereof corresponding to the side of the board containing the projections. The initial projection to enter the receptacle during board insertion and the initial stop encountered by the initial projection are offset dimensionally with respect to each other so that the initial projection bypasses the initial stop if the board is of the correct type for the receptacle.

DETAILED DESCRIPTION

Figure 1:
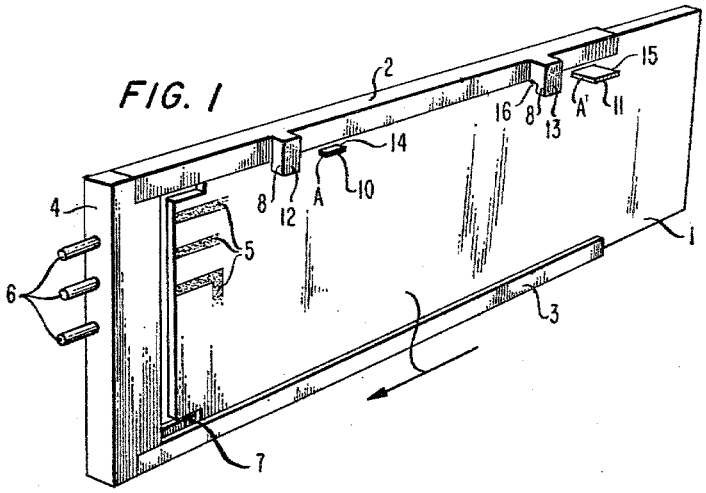
FIG. 1 shows a perspective view of a circuit board partially inserted into a correct receptacle. One illustrative embodiment of the invention is depicted by colinear stops on one guide rail of the receptacle and associated colinear projections along one edge of the board associated with the guide rail.

FIG. 1 shows a perspective view of a circuit board 1 partially inserted into a receptacle. For purposes of this discussion, the receptacle may be considered to comprise two guide rails 2 and 3 and a connector 4. The guide rails are U-shaped to form a channel 7 extending the length of each guide rail and which receives an edge of the circuit board to support it and to guide it into alignment with connector 4.

When board 1 is completely inserted into the receptacle, terminals 5 on the board are electrically connected to mating contacts (not shown) in connector 4. The connector contacts are electrically connected to contact pins 6. Ordinarily, a plurality of the guide rails and connectors are arranged side-by-side in a frame housing in a well-known manner to provide a large number of receptacles. Electrical wiring is arranged in a desired manner to the pins 6 of each of the receptacles so that when the proper circuit boards are inserted into the receptacles, the overall structure operates as a complete circuit to accomplish a desired function.

The circuit board of FIG. 1 has two projections 10 and 11 which are at locations on the board designated as A and A', respectively. As will be seen, A and A' are two of a plurality of similar locations on board 1 which are coded to form unique keys defining each type of board. Guide rail 2 has two stops 12 and 13 located along one of its edges on a side of the guide rail corresponding to the side of board 1 containing projections 10 and 11. Each stop has a dimension 8 which spans both the projections 10 and 11 of board 1 when inserted. The locations of stops 12 and 13 along the guide rail correspond, respectively, to the locations of the projections 10 and 11 with which they are individually associated. These locations are chosen such that neither of the projections will engage its respective stop before the board is completely inserted into the correct receptacle.

The plurality of locations referred to above are coded in a fashion similar to that in the aforementioned Grau et al disclosure. In Grau et al, however, one location, such as A, is in proximity to one guide rail, as in FIG. 1, and its associated location such as A' is in proximity to the other guide rail, or guide rail 3 in FIG. 1. The corresponding stops in Grau et al are located one on each of the guide rails in a fashion otherwise similar to that of FIG. 1. The structure of FIG. 1 is an improvement over Grau et al in the arrangement of the stops and projections which are located in proximity to only one board edge and guide rail and which are dimensionally offset with respect to each other to allow insertion of a board into its correct receptacle without interference between nonassociated projections and stops such as between projection 10 and stop 13.

In the embodiment of FIG. 1, the projection locations, including A and A', are colinear along the upper edge of board 1. The initial projection 10 to enter the receptacle during board insertion has a dimension 14 perpendicular to the board which is less than the corresponding dimension 15 of projection 11. The initial stop 13 encountered by projection 10 during board insertion is displaced from guide rail 2 in the direction of dimensions 14 and 15 by an amount 16 which is greater than dimension 14 and less than dimension 15. Stop 12, associated with projection 10, is not displaced from guide rail 2. Thus, it is seen that when board 1 is inserted into its correct receptacle as shown in FIG. 1, the initial projection 10 bypasses the initially encountered stop 13 because of its displacement 16 and continues on to interact with its associated stop 12. Similarly, projection 11 interacts with its associated stop 13. If the insertion of an incorrect board is attempted into the receptacle of FIG. 1, one or the other of stops 12 and 13 will engage a projection to prevent further insertion before the terminals 5 electrically engage the contacts in connector 4.

Figure 2:
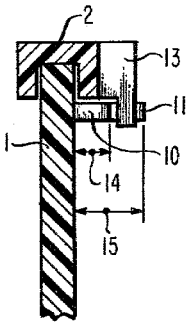
FIG. 2 shows a cross-sectional view of the guide rail of FIG. 1 illustrating one manner in which a nonassociated stop and projection are dimensionally offset with respect to each other to provide noninterference therebetween.

The embodiment of FIG. 1 is further clarified by FIG. 2 which shows a cross-sectional view of guide rail 2, projections 10 and 11, and displaced stop 13. The dimensions 14 and 15 are clearly set forth, illustrating how projection 10 passes inside of displaced stop 13 during insertion of board 1, while the longer projection 11 may encounter interference from stop 13. The non-displaced stop 12 associated with shorter projection 10 is not shown in FIG. 2.

Figure 3:
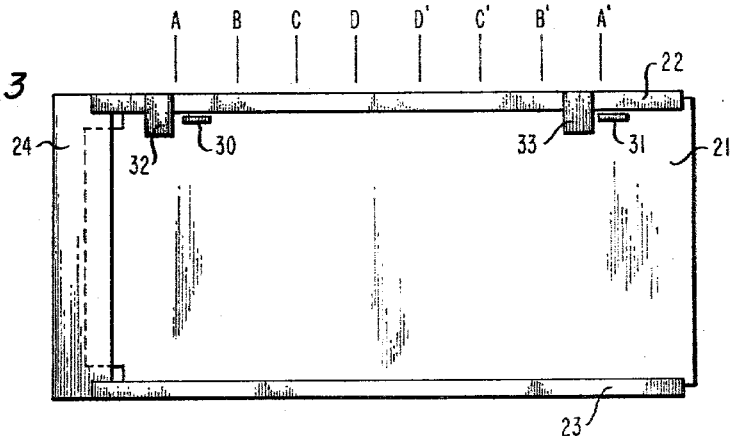
FIG. 3 depicts illustrative encoding locations on a guide rail and board for the stops and projections of the embodiment of FIGS. 1 and 2.

Referring now to FIG. 3, there is seen a front view of a board 21, encoded in a similar fashion as board 1 in FIG. 1, completely inserted into its correct receptacle. The designations A through D and A' through D' along the upper guide rail 22 indicate illustrative locations along the guide rail at which stops may be located. These designations also define the locations on board 21 at which projections may be located.

Each one of the locations A through D is individually associated with the correspondingly designated location A' through D'. The A through D locations and the A' through D' locations are ordered in opposite directions. This causes each associated pair of locations to define a unique key for each type of circuit board. Thus, projections and stops may be located at A–A', B–B', C–C' and D–D'.

The specific example of FIG. 3 shows one circuit board and receptacle type in which projections and stops are located at locations A and A'. It should be noted that board 21 is completely inserted into the receptacle and that projections 30 and 31 are just at the point of engaging their respective stops 32 and 33. Projection 30 has a shorter dimension perpendicular to board 21 than projection 31 and stop 33 is displaced from guide rail 22 all as shown in FIG. 1 so that stop 33 will not interfere with projection 30 during board insertion.

Figure 4:
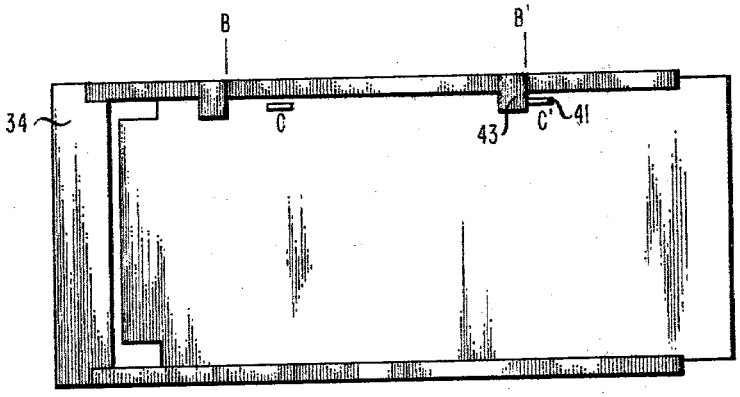
FIG. 4 illustrates how the stops and projections interact to prevent insertion of a board into an incorrect receptacle.

FIG. 4 shows the result of attempting to insert an incorrect type of board into a receptacle. A C–C' type of board is inserted into a B–B' type of receptacle. Note that the C' projection 41 engages the B' stop 43 before the board mates with connector 34. A similar result occurs for any board and receptacle which have different encodings.

The embodiment depicted in FIGS. 1 through 4 has the disadvantage that relatively few unique keys are possible. The specific illustrative embodiment of FIG. 3 has for example only 4 codes A–A' through D–D'. Additional codes could be provided through the judicious use of spacing between locations. The number of codes can also be increased substantially by providing stops and projections on both sides of both guide rails 22 and 23 and circuit board 21 in FIG. 2. This, however, consumes additional space and is undesirable.

Figure 7:
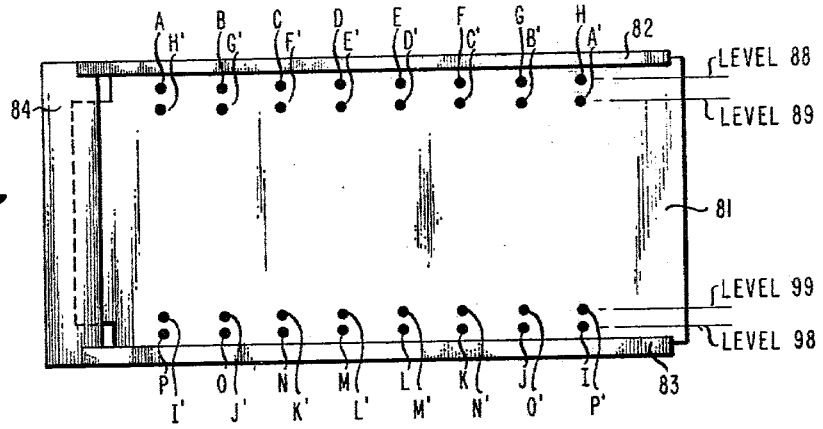
FIG. 7 depicts illustrative encoding locations on a guide rail and board for the stops and projections of the embodiment of FIG. 5.
Figure 8:
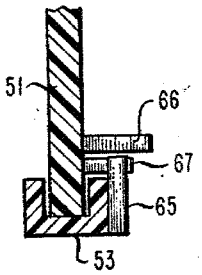
FIG. 8 shows a cross-sectional view of another guide rail of FIG. 5 depicting another mode of operation of the additional offset dimension.

An improved embodiment is shown in FIGS. 5 through 8 which provides an adequate number of codes for most applications and which requires space only on one side of the guide rails and boards. The structure of lower guide rail 53 is described subsequently herein. With reference to the upper guide rail 52 and the corresponding upper portion of board 51, stops 62 and 63 and projections 60 and 61 have all of the attributes of the corresponding stops and projections discussed in FIGS. 1 through 4 which allow projection 60 to bypass stop 63 during insertion of the board. That is, projection 60 has a shorter dimension perpendicular to the board than projection 61 and stop 63 is displaced from the board in relation to stop 62 in order to prevent interference with projection 60. This is shown more clearly in FIG. 6 which shows a cross-sectional view of guide rail 52. Nondisplaced stop 62 is not shown. In addition, projection 61 is located on a level of the board removed by a distance 69 from the upper edge of the board, whereas projection 60 is located on a different level removed from the upper board edge by a lesser distance 68. Stop 63 has a stopping surface of length 70 which spans both of the levels on which projections 60 and 61 are located. Stop 62 has a stopping surface of length 71 which spans only the level on which projection 60 is located. During the insertion of a correct board into a receptacle, the initial projection 60 to enter the receptacle passes inside of the initial stop 63 as in the embodiment of FIG. 1, allowing the projections 60 and 61 to interact only with their respective associated stops 62 and 63. The different levels on the board on which the projections are located allow for the assignment of additional encoding locations which may span the entire length of the board as shown in FIG. 7.

Referring now to FIG. 7, there is seen a board 81 inserted into a receptacle consisting of guide rails 82 and 83 and connector 84. With reference to the upper portion of board 81, the dots indicate a plurality of illustrative locations at which projections may be located in the embodiment of FIG. 5. These dots also define the locations on guide rail 82 at which associated stops may be located. For a given type of board, one projection is located at one of the locations A through H in the upper level 88 of locations and another is located in an associated one of the locations A′ through H′ in the lower level 89. As in Grau et al., each of the locations A through H is individually associated with the correspondingly designated location A′ through H′ and the A through H locations and the A′ through H′ locations are ordered in opposite directions. Thus, projections and stops may be located at A–A′, B–B′, C–C′, etc.

The number of keying combinations provided by defining locations along one guide rail such as 82 in FIG. 7 may be squared by providing stops and projections along the lower guide rail as well. Thus, level 98 contains locations designated as I through P and level 99 contains the associated locations I′ through P′ ordered in the opposite direction. As above, valid key combinations consist of the coded location pairs I–I′, J–J′, etc. This is more graphically illustrated in FIG. 5 by stops 64 and 65 and projections 66 and 67 along lower guide rail 53. In this case stops 64 and 65 are associated, respectively, with projections 66 and 67 and are assigned to associated locations on different levels of the board as shown in FIG. 7.

Figure 5:
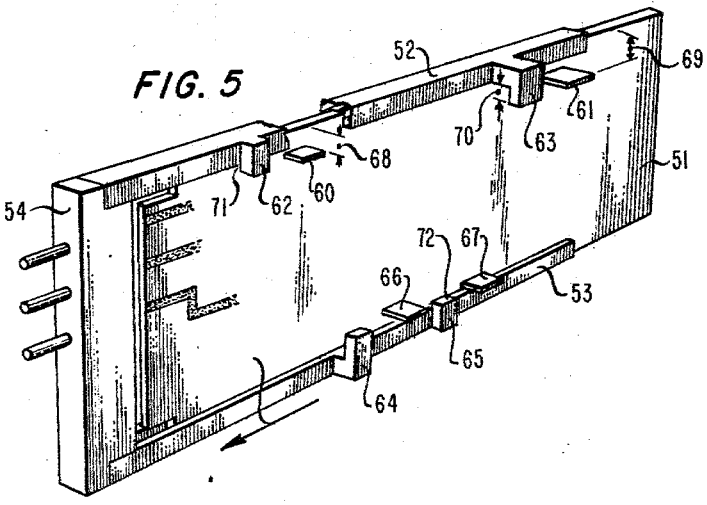
FIG. 5 illustrates another exemplary embodiment of the invention in which an additional offset dimension of the stops and projections is introduced.
Figure 6:
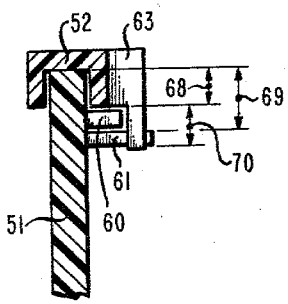
FIG. 6 shows a cross-sectional view of one of the guide rails of FIG. 5 clearly depicting the additional offset dimension and its mode of operation.

As shown by projections 60 and 61 in FIG. 5, the shorter projection 60 along the upper guide rail 52 is located in the upper level 88 and the longer projection 61 is located in the lower level 89. For key combinations which result in the shorter projection being to the left of the longer projection, that is, combinations A–A′, B–B′, C–C′ and D–D′ in FIG. 7, the shorter projection bypasses the initial stop in the receptacle by passing under it as projection 60 bypasses stop 63 in FIG. 5. For those encoding key combinations in which the longer projection is to the right of the shorter projection in FIG. 7, that is, combinations E–E′, F–F′, G–G′ and H–H′, the relative locations of the displaced and non-displaced stops are reversed along the guide rail. This is illustrated by the stops along the lower guide rail 53 in FIG. 5. During insertion of board 51, the longer projection 66 passes above the surface 72 of the non-displaced stop 65 because stop 65 only spans one level. Projection 66 continues on to interact with displaced stop 64 which spans both levels. This is more clearly illustrated in FIG. 8 which shows a cross-sectional view of guide rail 53, nondisplaced stop 65 and projections 66 and 67.

The location of the projections on different levels and the different spanning capabilities of the two stops controls the bypassing of the initial projection 66 and initial stop 65, rather than the displacement of the stops and the length of the projections as illustrated by the keying along the upper guide rail 52. However, as shown in FIG. 5, the different displacements of the stops on guide rail 53 is retained even though not used. Likewise, the different levels of the projections associated with guide rail 52 are unnecessarily retained. By designing in this guide rail redundancy, only 8 different guide rails need be manufactured for the illustrative embodiment of FIG. 5. In other words, an A–A′ guide rail 52, for example, can also be used as a P–P′ lower guide rail, etc.

Figure 9:
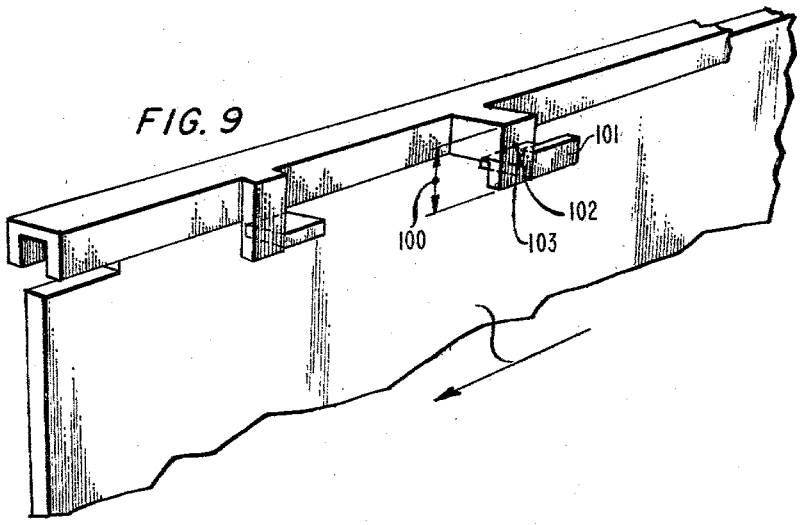
FIG. 9 shows an alternative and improved manner of constructing certain ones of the board projections.

FIG. 9 shows an improved embodiment of the arrangement of FIG. 5 in which the longer projection 101, corresponding to projection 61, for example, in FIG. 5, is bent at an angle approaching 90 degrees at an appropriate point along its length. The surface 102 of projection 101 that engages stop 103 is thereby substantially larger for increased strength. In addition, the dimension 100 of stop 103, which ordinarily must be relatively large to compensate for variations in circuit board and guide rail tolerances, can be made substantially shorter. This, in turn, reduces the interference the stop otherwise has with space on the circuit board for wiring, etc.

It is to be understood that the hereinbefore described arrangements are illustrative of the application of principles of the invention. In light of this teaching, it is apparent that other arrangements may be devised by those skilled in the art without departing from the spirit and scope of the invention.

I claim:

1. For use with plug-in circuit boards and circuit board receptacles having first and second guide rails for guiding the insertion of boards into the receptacles, a keying arrangement for preventing the insertion of boards into any but correct receptacles, comprising a first projection located on a said board in one of a plurality of first coded surface locations colinearly arranged along the board in the direction of insertion of said board into a receptacle, a second projection located on said board in an associated one of a like plurality of second coded locations also colinearly arranged in the direction of insertion of said board, each of the first locations being associated with a different one of the second locations and associated ones of the first and second locations being ordered in opposite directions, wherein each pair of associated first and second locations defines a unique circuit board key, and first and second stops in a said receptacle designed to receive said board, the first and second stops being associated, respectively, with the first and second projections and located in said receptacle in the same spatial relationship as their respective associated projections, the arrangement being CHARACTERIZED IN THAT the first and second locations are proximate to and parallel to one edge of the board associated with one of the guide rails, both of the first and second stops are fixedly attached to said one of the guide rails on a side thereof corresponding to the side of the board containing the projections, both the first and second stops have a dimension perpendicular to the direction of insertion and parallel to the surface of the board spanning both the first and second projections, an initial one of the projections to enter the receptacle during board insertion has a dimension perpendicular to the board surface which is less than the corresponding dimension of the remaining projection, and an initial stop encountered by the initial projection is displaced further from the board surface than the remaining stop by an amount greater than the dimension of said initial projection and less than the corresponding dimension of the remaining projection.

2. The invention of claim 1, wherein the first locations and the second locations are located on different levels of the board with respect to said one guide rail, said initial projection is located on one of the levels furthest from said one guide rail and the remaining projection is located on the remaining level, said initial stop has a dimension perpendicular to the direction of insertion and parallel to the board spanning only one of the levels, and the remaining one of the stops has a corresponding dimension spanning both of the levels.

3. The invention of claim 1 wherein the first locations and the second locations are located, respectively, on first and second levels on the board, the first level being located a prescribed distance from said one edge of the board and the second level being located further from said one edge than the first level, the first projection is located on the first level and has a prescribed dimension perpendicular to the board surface, the second projection is located on the second level and has a dimension perpendicular to the board surface greater than the prescribed dimension of the first projection, the first stop has a dimension perpendicular to the direction of insertion of the board and parallel to the surface of the board spanning only the first level, the second stop has a dimension corresponding to the last-mentioned dimension spanning both the first and second levels, the first stop is displaced from the surface of the board by a distance less than the prescribed dimension of the first projection, and the second stop is displaced from the board by a distance greater than said prescribed dimension and less than the corresponding dimension of the second projection.

* * * * *